US011564466B2

(12) United States Patent
Clarete et al.

(10) Patent No.: US 11,564,466 B2
(45) Date of Patent: Jan. 31, 2023

(54) CUSTOMIZABLE WALLET

(71) Applicant: 3Rius Design Innovation Inc., Toronto (CA)

(72) Inventors: Robeco Clarete, Toronto (CA); Mikhael Zobel, Vaughan (CA)

(73) Assignee: 3Rius Design Innovation Inc., Toronto (CA)

( * ) Notice: Subject to any disclaimer, the term of this patent is extended or adjusted under 35 U.S.C. 154(b) by 95 days.

(21) Appl. No.: 17/304,326

(22) Filed: Jun. 18, 2021

(65) Prior Publication Data

US 2022/0400823 A1 Dec. 22, 2022

(51) Int. Cl.
*A45C 1/06* (2006.01)
*A45C 11/18* (2006.01)

(52) U.S. Cl.
CPC ..... *A45C 1/06* (2013.01); *A45C 11/182* (2013.01); *A45C 2001/067* (2013.01); *A45C 2011/186* (2013.01); *A45C 2200/10* (2013.01)

(58) Field of Classification Search
CPC ... A45C 1/06; A45C 11/182; A45C 2001/067; A45C 2011/186; A45C 2200/10
See application file for complete search history.

(56) References Cited

U.S. PATENT DOCUMENTS 953,953 A * 4/1910 Inglee ..... B65D 83/12 312/61
2011/0161187 A1* 6/2011 Albrecht ..... G06Q 20/204 705/17
2015/0216278 A1* 8/2015 Yeung ..... A45C 13/007 150/147
2020/0060403 A1* 2/2020 Robinson ..... A45C 13/02
2020/0229557 A1* 7/2020 Tran ..... B25F 1/006

OTHER PUBLICATIONS

MGEAR 2.0: https://www.youtube.com/watch?v=YvQ4eeJOM-U (Year: 2020).*
MGEAR 2.0 Review: https://www.youtube.com/watch?v=4SkUR54HSjg (Year: 2020).*
Ridge Wallet: https://www.amazon.com/Ridge-Authentic-Minimalist-Blocking-Wallet/dp/B07F6FSDHS (Year: 2019).*

* cited by examiner

*Primary Examiner* — John K Fristoe, Jr.
*Assistant Examiner* — Justin Caudill
(74) *Attorney, Agent, or Firm* — Orin Del Vecchio

(57) ABSTRACT

A wallet is provided and, in particular, a customizable wallet is provided which is comprised of removable and replaceable components. The components may include a frame; a front frame, secured to an exterior surface of the frame; a tensioning mechanism secured within the frame, the tensioning mechanism further defining a space between the front frame and the tensioning mechanism, the defined space dimensioned to hold one or more credit card-sized items. Further components may include a removable front plate, the front plate secured within the frame behind the front frame via the tensioning mechanism, and a removable backplate, the backplate secured within the frame via the tensioning mechanism; and wherein the front plate and the backplate are independently removable via application of pressure to the tensioning mechanism.

16 Claims, 9 Drawing Sheets

2/9

CUSTOMIZABLE WALLET

FIELD OF THE INVENTION

The present specification relates generally to a wallet, and more particularly to a customizable wallet formed from removable and replaceable components.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

Wallets are a ubiquitous accessory carried by both men and women. Various styles of wallets (folding, sleeve, card-only) are known and carried based on the user's preference and requirements. There is also a demand for a more rigid style of wallet that provides greater protection to the contents within.

It is a problem that modifying or upgrading requires the user to purchase a new wallet and move items. A similar problem is created if a user has multiple wallets for different purposes. Therefore, it would be desirable to provide a customizable wallet which enables the user to change the appearance as desired, while also providing the rigid protective style demanded by modern users.

However, existing attempts to provide customizable wallets create additional problems. Many wallets use screws to secure the elements in place, which requires tools to remove or modify the elements, and further creates a risk of misplacing or damaging the tools and/or screws, and further may require the user to have a degree of proficiency in tool use.

In another example, magnets are commonly used to hold elements in place, which creates risk of damage to magnetic stripe and chip-enabled cards. Attempts to rectify this issue via degaussing elements requires greater attention from the user and produces inconsistent results.

Thus, while there are some modifiable wallets known in the art, it would be desirable to have a wallet which provides some of the desired functionality and/or which mitigates some of the disadvantages thereof.

Accordingly, there remains a need for improvements in the art.

SUMMARY OF THE INVENTION

In accordance with an aspect of the invention, there is provided a customizable wallet formed from removable and replaceable components.

According to an embodiment of the invention, there is provided a customizable wallet, the wallet comprising: a frame; a front frame, secured to and exterior surface of the frame; a tensioning mechanism secured within the frame, the tensioning mechanism further defining a space between the front frame and the tensioning mechanism, the defined space dimensioned to hold one or more credit card-sized items; a removable front plate, the front plate secured within the frame behind the front frame via the tensioning mechanism, and a removable back plate, the back plate secured within the frame via the tensioning mechanism; and wherein the front plate and the back plate are independently removable via application of pressure to the tensioning mechanism.

The frame may further comprise a securing mechanism on at least one side, the securing mechanism enabling an accessory holder to be secured to at least one side of the from, the accessory holder operative to hold one or more accessories. One or more accessories may comprise a pen, a flashlight, a storage container, and a combination thereof.

The backplate may comprise a secondary storage compartment. The secondary storage compartment may comprise two or more separate storage compartments. The separate storage compartments may then be dimensioned to hold one or more of: a USB drive, an SD card, and a battery.

The wallet may further comprise one or more credit card-sized items, the credit card-sized items dimensioned to fit within the card storage compartment. The one or more card-sized non-card items may comprise one or more of: a multi-tool, a USB drive, a measuring tool, a conversion guide, a data card, and a combination thereof.

The frame may further comprise a transparent panel, the transparent panel covering other credit card-sized items within the card storage compartment. The transparent panel may be formed as a Fresnel lens. Further, the transparent panel may permit the wallet to be used without a front plate.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

Other aspects and features according to the present application will become apparent to those ordinarily skilled in the art upon review of the following description of embodiments of the invention in conjunction with the accompanying figures.

BRIEF DESCRIPTION OF THE DRAWINGS

Reference will now be made to the accompanying drawings which show, by way of example only, embodiments of the invention, and how they may be carried into effect, and in which.

Like reference numerals indicate or corresponding elements in the drawings.

DETAILED DESCRIPTION OF THE EMBODIMENTS

Figure 1A:
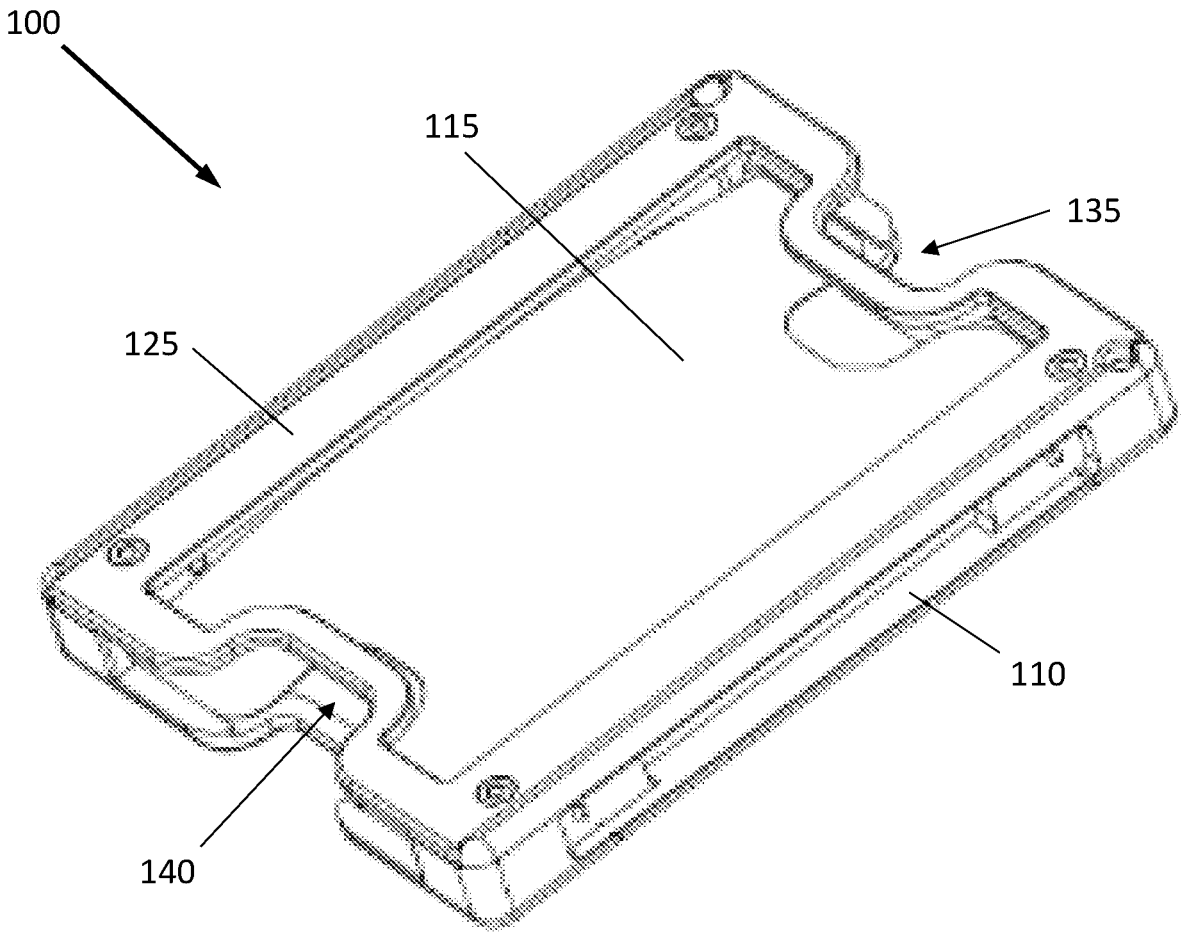
FIG. 1A is a perspective view of a wallet according to an embodiment.
Figure 1B:
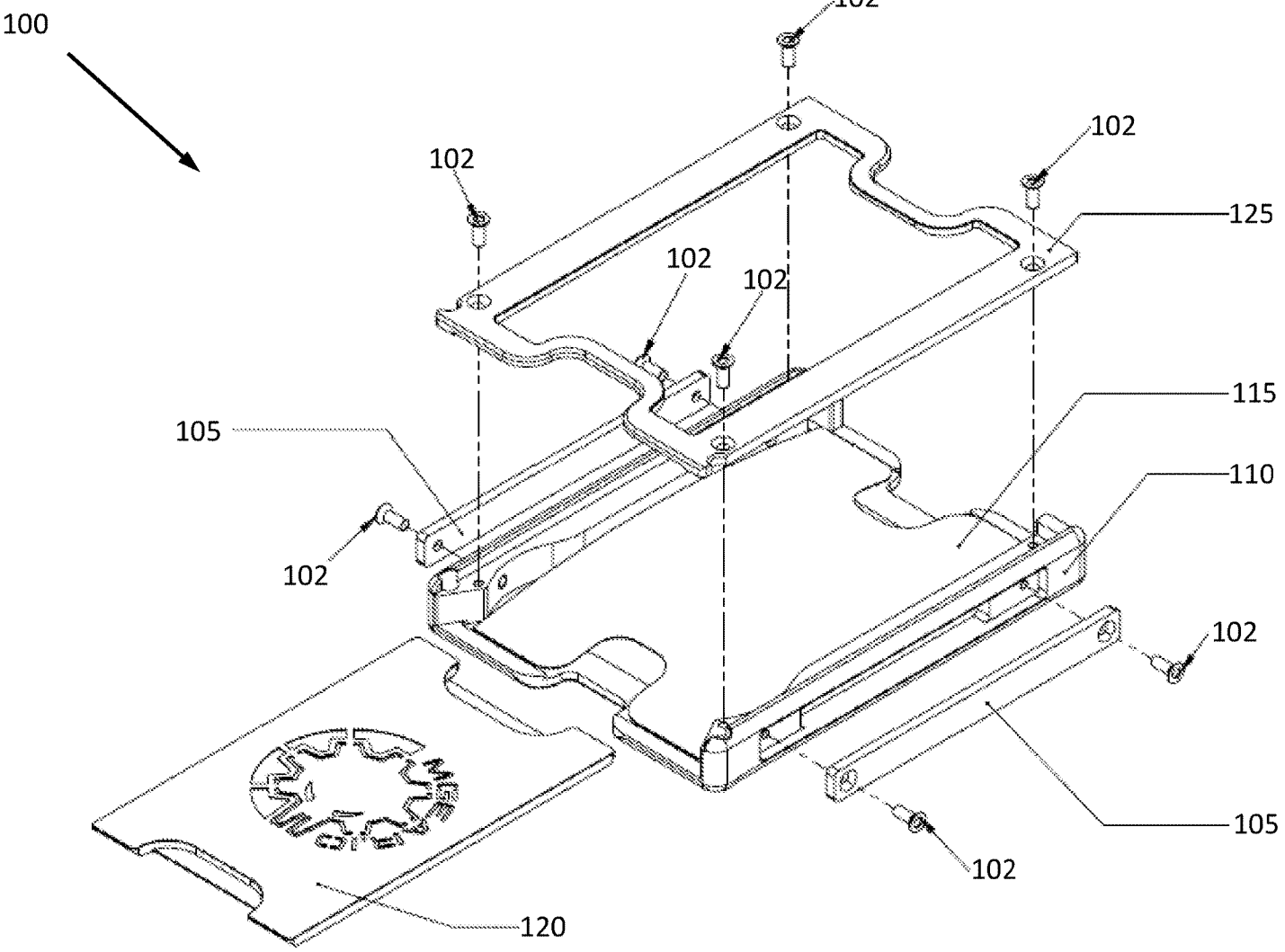
FIG. 1B is an exploded view of FIG. 1A.
Figure 2:
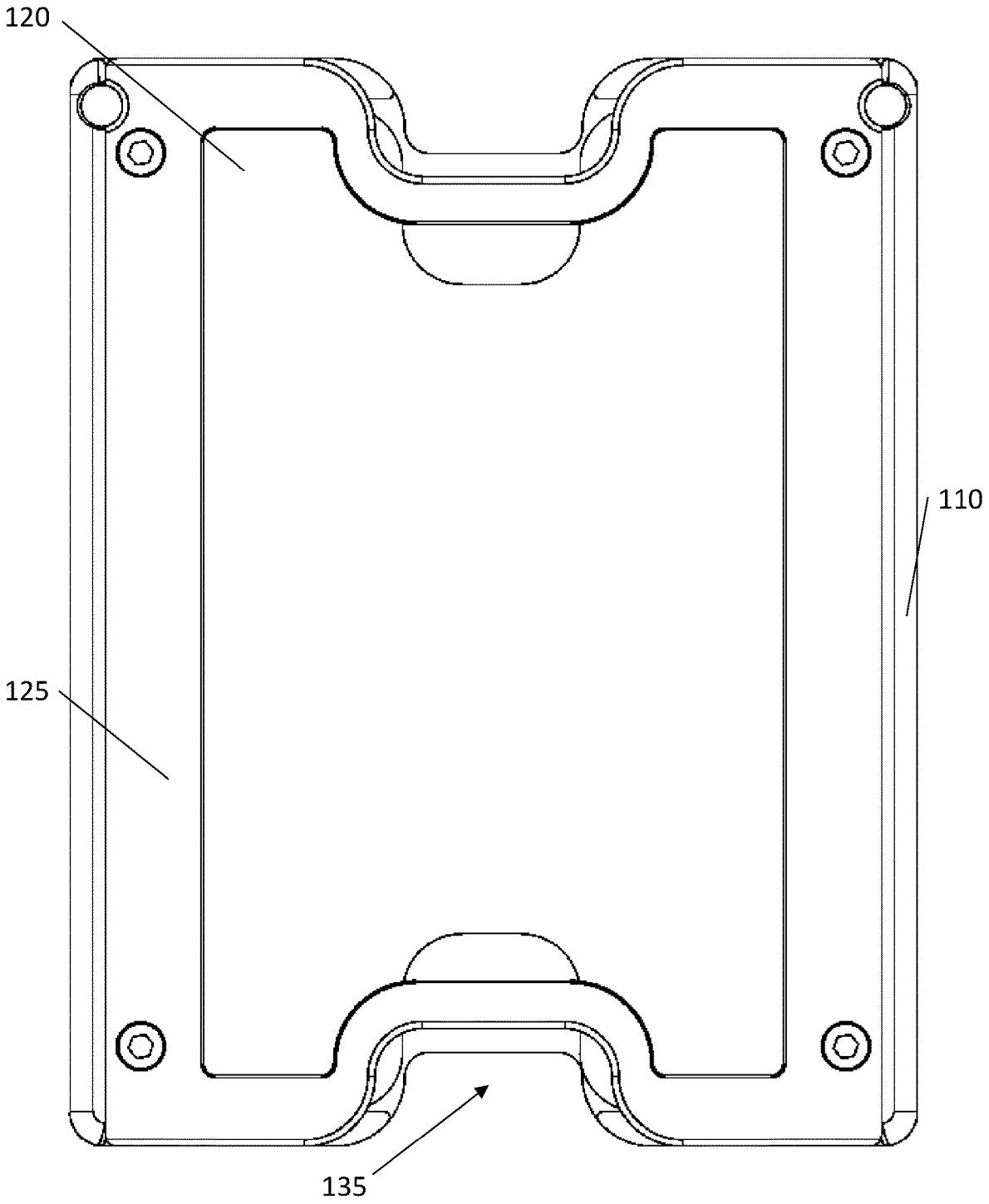
FIG. 2 is a front view of the wallet of FIG. 1A.
Figure 3:
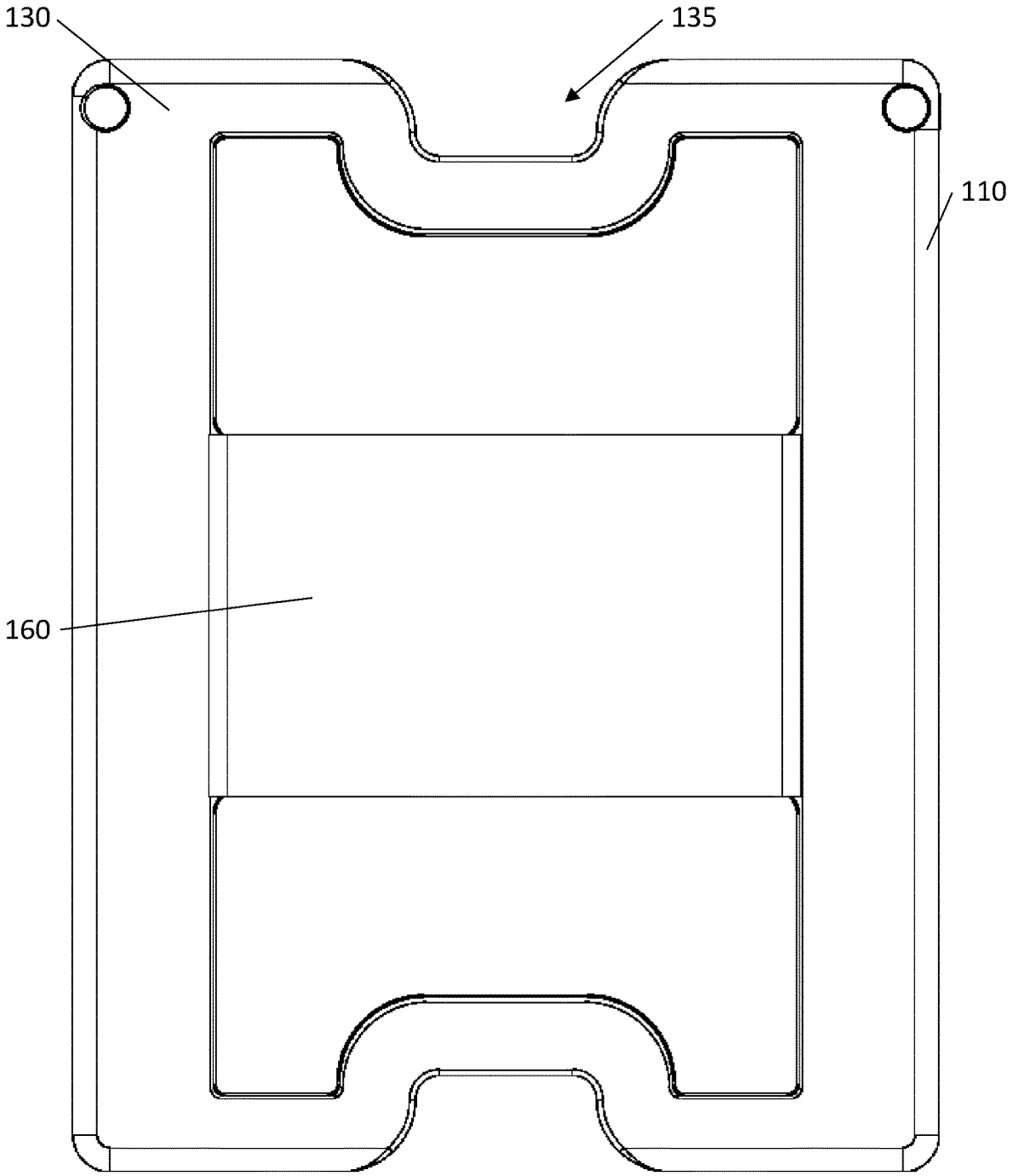
FIG. 3 is a back view of the wallet of FIG. 1A.

The present invention relates to a wallet and, in particular, to a customizable wallet formed from removable and replaceable components.

According to an embodiment as shown in FIGS. 1A, 1B, 2 and 3, a customizable wallet 100 is provided. The wallet 100 is formed from frame 110, with an integrated tensioning mechanism 115, such as a spring steel plate. A front frame 125 is secured to the front of the frame, covering the tensioning mechanism 115. The front frame 125 and tensioning mechanism 115 define a space within the frame 110. A card storage compartment 140 is created within the defined space to hold one or more credit card-sized items, generally credit or debit cards, however, other similarly sized items may be used, as discussed below.

A front plate 120 may be further secured within the frame 110 behind the front frame 125 via the tensioning mechanism 115. The front plate 120 acts to protect items within the card storage compartment 140, as well as providing decorative and aesthetic features, if desired. Similarly, a back plate 130 may be further secured within the frame 110 via the tensioning mechanism 115. In such cases, the card storage compartment 140 is thus defined between the front plate 120 and back plate 130, or between the back plate 130 and front frame 125.

The items within the card storage compartment 140 are secured in place via pressure between the front frame 125 and the tensioning mechanism 115. Accordingly, the items may be removed from the wallet 100 by application of pressure using the notches 135, or through an opening in front frame 125, if not front plate 120 is present. Thus, items may be inserted and/or removed from card storage compartment 140 via sliding out one of the ends of the frame 110. In a preferred embodiment, card storage compartment 140 is dimensioned to hold five credit card-sized items, although the number of cards may be varied based on the dimensions of the frame 110.

Figure 4:
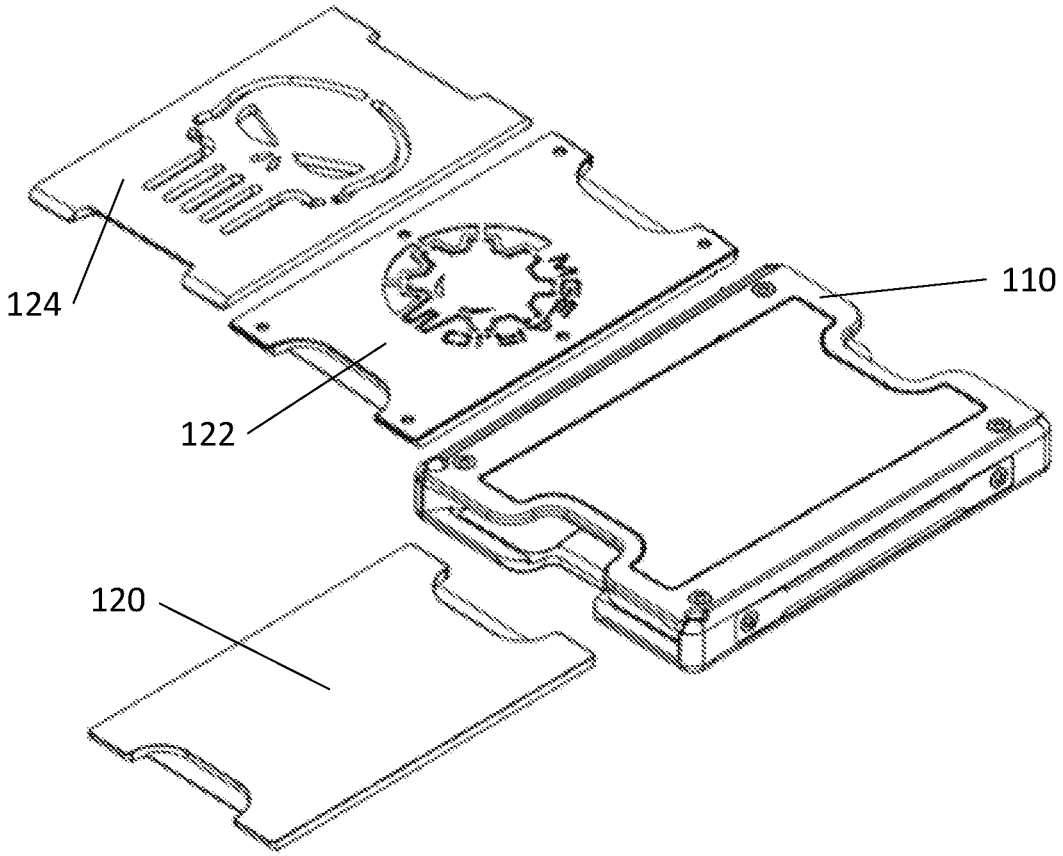
FIG. 4 is a perspective view of the wallet of FIG. 1A with a set of removable front plates.

Additionally, as shown in FIG. 4, front plate 120 may be removed by applying pressure to the front plate 120 and thereby to the tensioning mechanism 115, which then permits front plate 120 to be slidably moved out of the frame 110 by one of the ends. Front plate 120 may therefore be replaced with an alternate front plate 120 to change the appearance of front plate 120. Front plate 120 may also be replaced for functional reasons, such as to insert an RFID blocking front plate as discussed below.

Similarly, back plate 130 may be removed by applying pressure to the back plate 130 and thereby to the tensioning mechanism, which then permits back plate 130 to be slidably moved out of frame 110 by one of the ends. Back plate 130 may therefore be replaced with an alternate back plate 130 to change the appearance of back plate 130.

Figure 5:
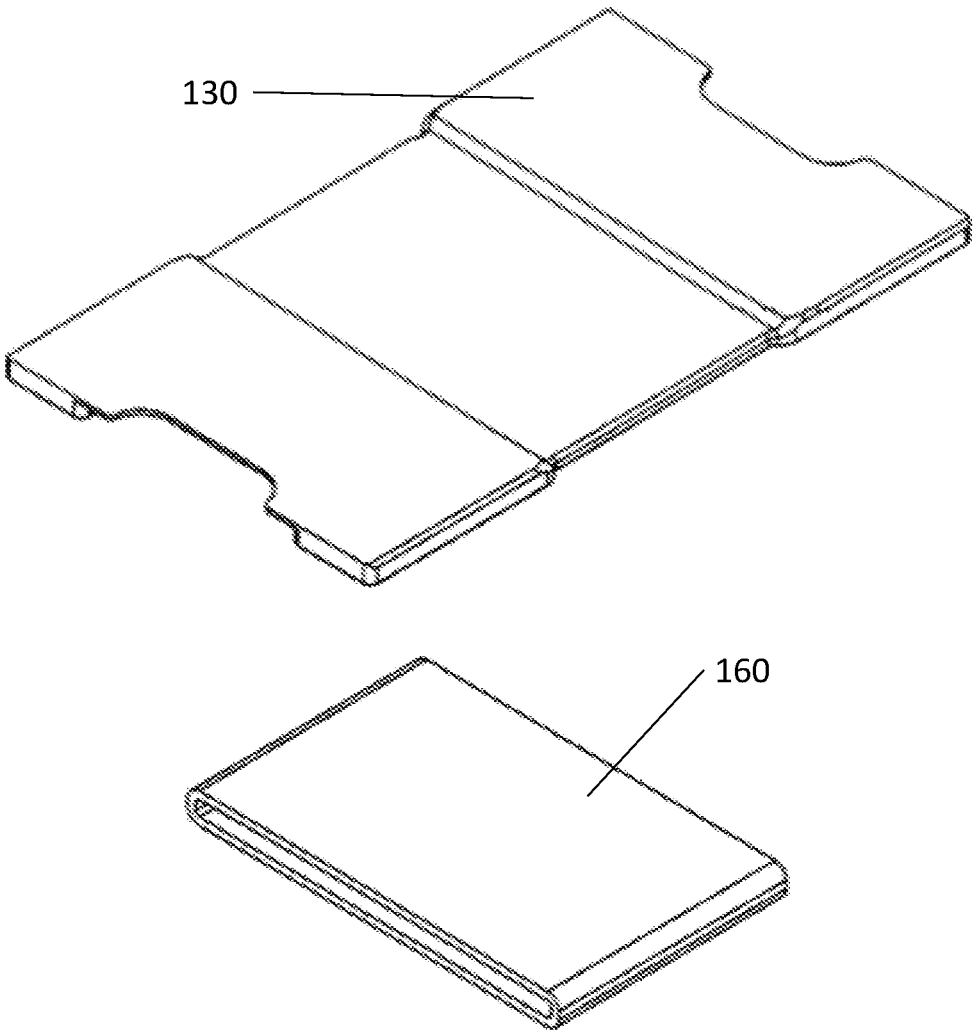
FIG. 5 is a perspective view of a back plate and removable band.

Back plate 130 may also be replaced for functional reasons and change the type of back plate 130. While the simplest form of back plate 130 is a plain solid plate, a preferred version may include an elastic or silicone band 160 which extends over the exterior surface of back plate 130 as shown in FIG. 5. Items (money, additional cards, etc.) may then be secured to the wallet 100 via the band 160 and/or band 160 may be used to secure the wallet 100 to an item such as an article of clothing, a belt or purse clip, or a wallet-specific holder (such as may be mounted in a vehicle).

Figure 6:
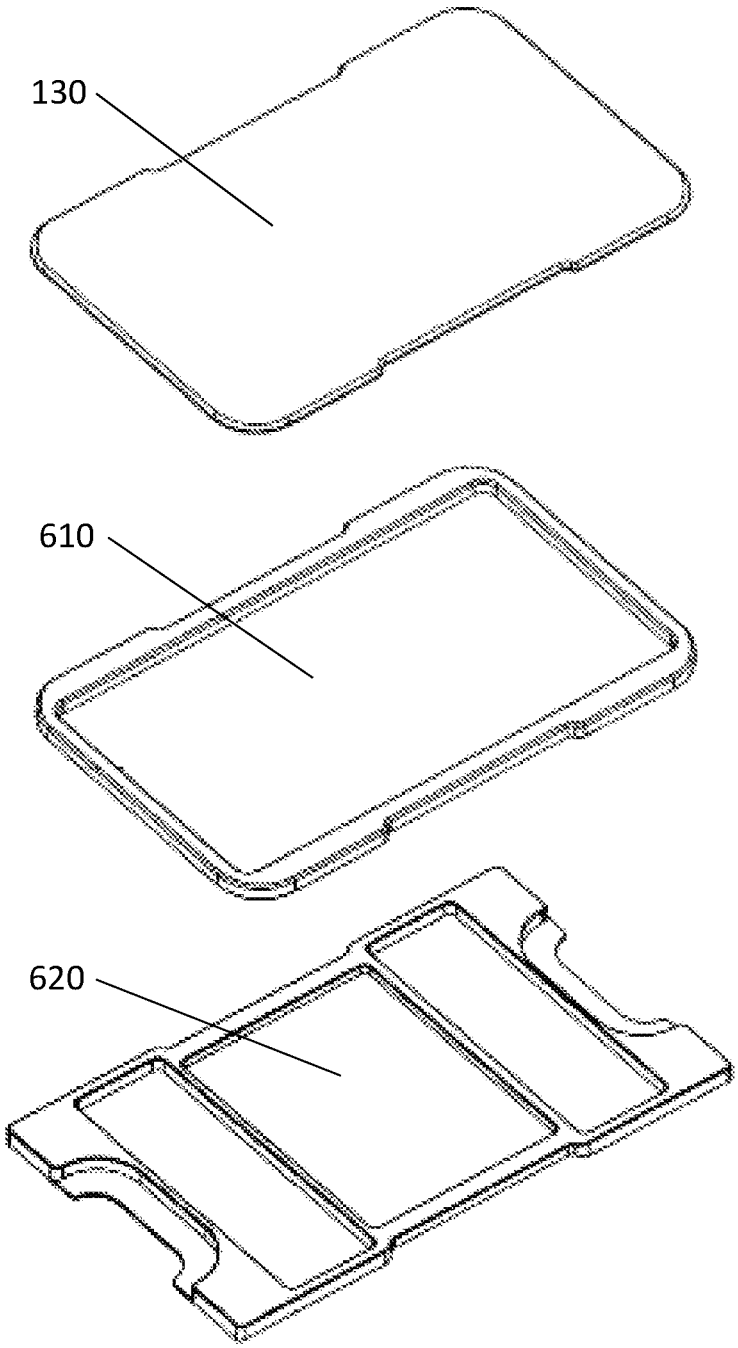
FIG. 6 is a perspective view of alternate back plates.

Other functional types of back plate 130 may be used as shown in FIG. 6. For example, back plate 130 may be formed as a secondary storage compartment 610, to allow for storage of small or loose items (coins, etc.) that would not otherwise be storable within the card storage compartment. The secondary storage compartment may further be divided in smaller compartments 620, which permits for secured storage of specific items, such as SD cards, USB drives, and/or batteries.

Figure 7A:
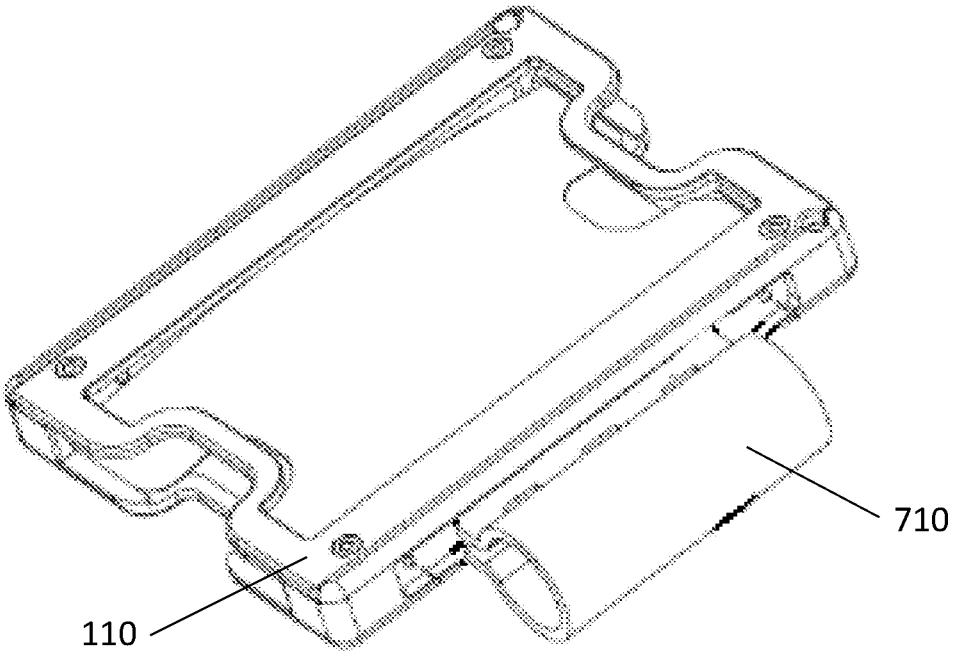
FIG. 7A is a perspective view of an embodiment of a wallet with a side accessory holder.
Figure 7B:
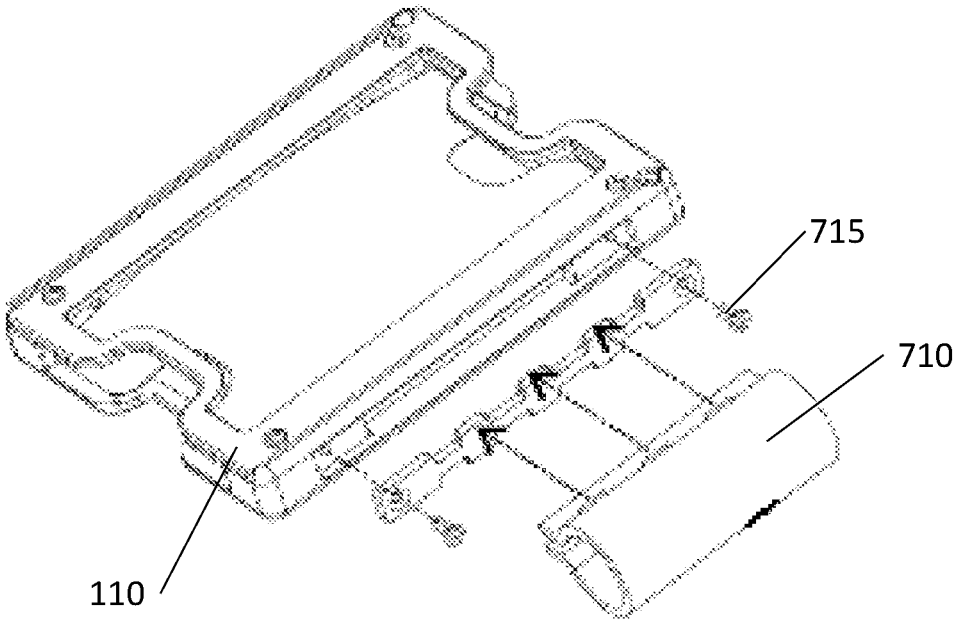
FIG. 7B is an exploded perspective of the wallet of FIG. 7A.
Figure 8:
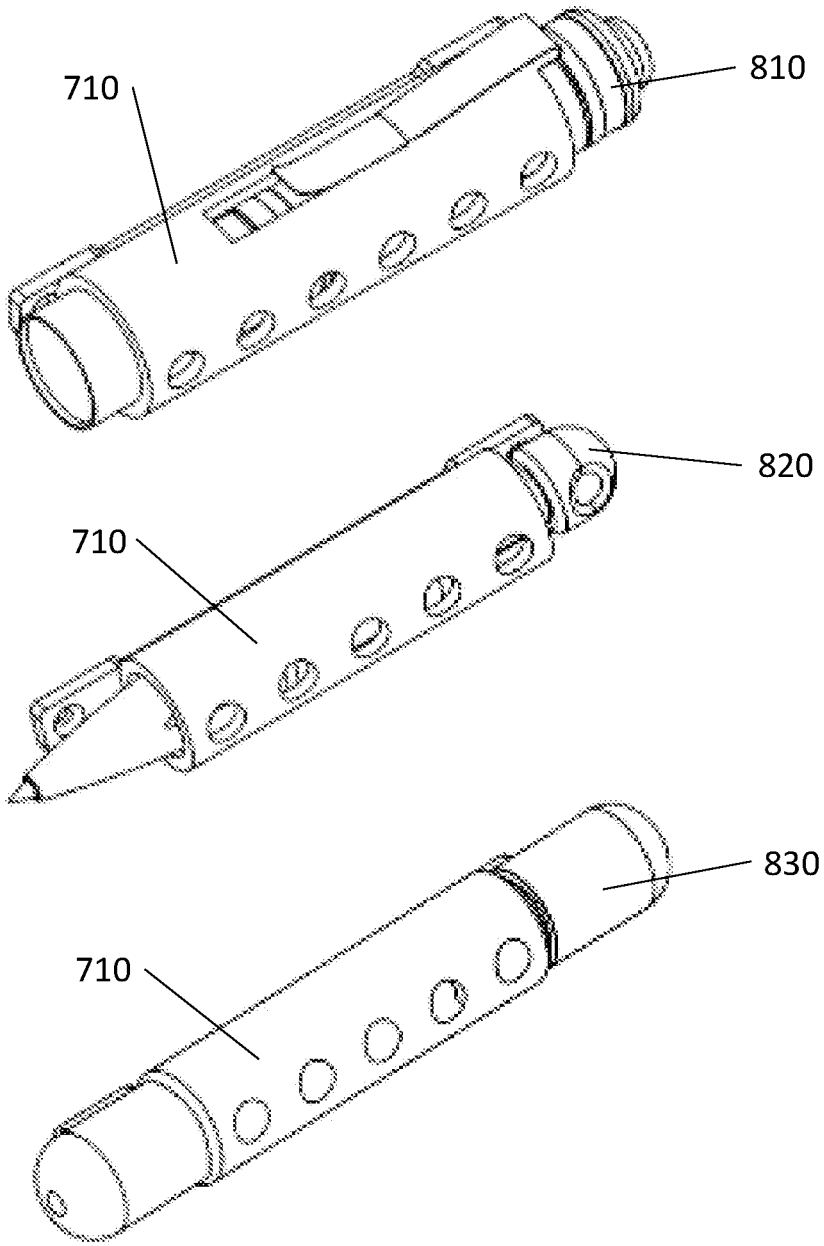
FIG. 8 is a perspective view of various accessories.

As an additional embodiment as shown in FIGS. 7A and 7B, an accessory holder 710 may be mounted to the side of frame 110 by M2 screws 715 or a similar securing mechanism. Accessory holder 710 thereby permits the attachment of accessories that would otherwise be too large to fit within the wallet. Some examples may include a pen 810, a flashlight 820, or an additional storage compartment 830 as shown in FIG. 8.

As discussed above, card storage compartment 140 is designed to hold standard credit card-sized items which would traditionally be found in a wallet. Such items include, but are not limited to, credit cards, debit cards, reward cards, membership cards, identity cards, and card-sized photographs.

As a further embodiment, additional credit card-sized items may be provided which fit within the card storage compartment 140, such as a multi-tool, a USB drive, a measuring tool, a conversion guide, a data card, and/or various combinations thereof. In an embodiment, one of the credit card-sized items is a transparent shield, which would be inserted as the top element in the card storage compartment 140 to protect the other cards inserted into card storage compartment 140 from scratches and damage. The transparent shield is of particular use where no front plate 120 is present. In a further embodiment, for additional functionality, the transparent shield may be formed as a Fresnel lens.

Construction materials for the wallet 100 and accessory holder 710 may be selected as desired based on considerations such as durability, rigidity, weight and appearance. As an example, frame 110 may be formed from aluminum, with front plate 120 and back plate 130 formed from carbon fiber, and accessory holder 710 formed from leather or plastic (hard or flexible). Alternatives may include steel (stainless or brushed) for any or all of the frame 110, front plate 120 and back plate 130. Front frame 125 may be formed from similar materials.

For greater protection, as discussed above, front plate 120 and back plate 130 may be formed from RFID blocking materials such as aluminum to block attempts to read data from the items within card storage compartment 140.

It be noted that, under appropriate circumstances, considering such issues as design preference, user preferences, marketing preferences, cost, structural requirements, available materials, technological advances, etc., other embodiments and methods are taught herein. It should also be noted that the steps described in any method of use can be carried out in many different orders according to user preference. The use of "step of" should not be interpreted as "step for", in the claims herein and is not intended to invoke the provisions of 35 U.S.C. § 112(f).

The embodiments of the invention described herein are exemplary and numerous modifications, variations and rearrangements can be readily envisioned to achieve substantially equivalent results, all of which are intended to be embraced within the spirit and scope of the invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

The present invention may be embodied in other specific forms without departing from the spirit or essential characteristics thereof. Certain adaptations and modifications of the invention will be obvious to those skilled in the art. Therefore, the presently discussed embodiments are considered to be illustrative and not restrictive, the scope of the invention being indicated by the appended claims rather than the foregoing description and all changes which come within the meaning and range of equivalency of the claims are therefore intended to be embraced therein.

What is claimed is:

1. A customizable wallet, the wallet comprising:

a frame;

a front frame secured to the exterior surface of the frame;

a tensioning mechanism secured within the frame, the tensioning mechanism further defining a space between the front frame and the tensioning mechanism, the defined space dimensioned to hold one or more credit card-sized items;

a removable front plate, the front plate secured within the frame behind the front frame via the tensioning mechanism, a removable backplate, the backplate secured within the frame via the tensioning mechanism; and wherein the front plate and the backplate are independently removable via application of pressure to the tensioning mechanism.

2. The wallet of claim 1, wherein the backplate further comprises a silicone band operative to secure items to an exterior surface of the backplate.

3. The wallet of claim 1, wherein the frame further comprises a securing mechanism on at least one side, the securing mechanism enabling an accessory holder to be secured to at least one side of the from, the accessory holder operative to hold one or more accessories.

4. The wallet of claim 3, wherein the one or more accessories comprise a pen, a flashlight, a storage container, and a combination thereof.

5. The wallet of claim 1, wherein the front and back plate are slidably removable from the frame.

6. The wallet of claim 1, wherein the backplate comprises a secondary storage compartment.

7. A wallet of claim 6, wherein the secondary storage compartment comprises two or more separate storage compartments.

8. The wallet of claim 7, wherein the separate storage compartments are dimensioned to hold one or more of a USB drive, an SD card, and a battery.

9. The wallet of claim 1, wherein the front plate and back plate are further comprised of RFID blocking materials.

10. The wallet of claim 1, further comprising one or more credit card-sized items, the credit card-sized items dimensioned to fit within the card storage compartment.

11. The wallet of claim 10, wherein the one or more card-sized non-card items comprise one or more of: a multi-tool, a USB drive, a measuring tool, a conversion guide, a data card, and a combination thereof.

12. The wallet of claim 1, wherein the front plate further comprises user-specific graphical features.

13. The wallet of claim 1, wherein the front plate and back plate are primarily formed from carbon fiber.

14. The wallet of claim 10, wherein one of the credit-card-sized items is a transparent panel, the transparent panel covering other credit card-sized items within the card storage compartment.

15. The wallet of claim 14, wherein the transparent panel is a Fresnel lens.

16. The wallet of claim 14, wherein the transparent panel permits the wallet to be used without a front plate.

* * * * *